US007451542B2

(12) United States Patent
Brand et al.

(10) Patent No.: US 7,451,542 B2
(45) Date of Patent: Nov. 18, 2008

(54) METHOD OF MANUFACTURE OF HEAT-EXCHANGER TUBE STRUCTURED ON BOTH SIDES

(75) Inventors: Karine Brand, Illerrieden (DE); Andreas Knoepfler, Ulm (DE); Andreas Beutler, Weissenhorn (DE); Ronald Lutz, Blaubeuren (DE)

(73) Assignee: Wieland-Werke AG, Ulm (DE)

( * ) Notice: Subject to any disclaimer, the term of this patent is extended or adjusted under 35 U.S.C. 154(b) by 318 days.

(21) Appl. No.: 11/109,447

(22) Filed: Apr. 19, 2005

(65) Prior Publication Data

US 2005/0241150 A1 Nov. 3, 2005

Related U.S. Application Data

(62) Division of application No. 10/295,813, filed on Nov. 15, 2002, now abandoned.

(30) Foreign Application Priority Data

Nov. 16, 2001 (DE) ..... 101 56 374

(51) Int. Cl.
*B21D 53/06* (2006.01)

(52) U.S. Cl. ..... 29/890.048; 29/890.03; 29/890.045; 29/890.046; 29/890.05; 29/890.053

(58) Field of Classification Search ..... 29/890.03, 29/890.045, 890.046, 890.048, 890.05, 890.053
See application file for complete search history.

(56) References Cited

U.S. PATENT DOCUMENTS 4,692,978 A * 9/1987 Cunningham et al. .. 29/890.048

FOREIGN PATENT DOCUMENTS

JP 62-255794 11/1987

* cited by examiner

*Primary Examiner*—David P Bryant
*Assistant Examiner*—Sarang Afzali
(74) *Attorney, Agent, or Firm*—Flynn, Thiel, Boutell & Tanis, P.C.

(57) ABSTRACT

The invention relates to a heat-exchanger tube structured on both sides with excellent heat transfer characteristics utilizing both outer and also inner fins and secondary grooves intersecting the inner fins. Two spaced-apart rolling tools are provided in the utilized device in order to form the outer fins of two adjacent rolling tools; the inner structure is formed by two differently profiled mandrels. The first mandrel forms in a first forming area the inner fins. The second mandrel forms in a second forming area the inventive secondary grooves into the earlier created inner fins.

16 Claims, 5 Drawing Sheets

METHOD OF MANUFACTURE OF HEAT-EXCHANGER TUBE STRUCTURED ON BOTH SIDES

CROSS REFERENCE TO RELATED APPLICATION

This is a division of U.S. patent application Ser. No. 10/295,813, filed Nov. 15, 2002, now abandoned.

FIELD OF THE INVENTION

The invention relates to metallic heat-exchanger tubes structured on both sides, in particular finned tubes.

BACKGROUND OF THE INVENTION

Heat transfer occurs in many areas of the air conditioning and refrigeration engineering and in the process and energy engineering. Shell and tube heat exchangers are often utilized in these areas for heat transfer. A liquid flows hereby on the inside of the tube in many applications, which liquid is cooled off or heated depending on the direction of the heat flow. The heat is given to the medium on the outside of the tube or is removed from said medium. Tubes, which are structured on both sides, constituting the state of the art, are utilized in shell and tube heat exchangers instead of plain tubes. This intensifies the heat transfer on the inside of the tube and on the outside of the tube. The heat-flux is increased, and the heat exchanger can be built more compactly. As an alternative, it is possible to maintain the heat-flux and to lower the driving temperature difference, thus enabling a more energy-efficient heat transfer.

Structured heat-exchanger tubes for shell and tube heat-exchangers have usually at least one structured area and plain ends and possibly plain center lands. The plain ends and plain center lands define the structured areas. In order for the tube to be able to be installed without any problems into the shell and tube heat-exchanger, the outer diameter of the structured areas may not be larger than the outer diameter of the plain ends and plain center lands.

Integrally rolled finned tubes are often being utilized as structured heat-exchanger tubes. Integrally rolled finned tubes are finned tubes where the fins are formed out of the wall material of a plain tube. Finned tubes have on their outside annularly or helically extending fins. They have in many cases on the inside of the tube a plurality of axially parallel or helically extending fins, which improve the heat-transfer coefficient on the inside of the tube. These inner fins extend with a constant cross-section parallel to the axis of the tube or in the form of helixes at a specific angle to the axis of the tube. The higher the inside fins, the greater is the improvement of the heat-transfer coefficient. The manufacture of such tubes is described, for example, in DE 23 03 172. It is of importance hereby that by using a profiled mandrel to produce the inner fins, which use is disclosed in said patent, the dimensions of the inner and the outer structure of the finned tubes can be adjusted independently of one another. Thus both structures can be adapted to the respective requirements and thus the tube can be designed at an optimum.

Lately many possibilities have been developed to further increase, depending on the use, the heat transfer on the outside of integrally rolled finned tubes by providing the fins on the outside of the tube with further structural characteristics. For example, in the case of condensation of refrigerants on the outside of the tube, the heat-transfer coefficient is clearly increased when the fin flanks are provided with additional convex edges (U.S. Pat. No. 5,775,411). It has proven to increase performance during boiling of refrigerants on the outside of the tube when the channels between the fins are partly closed so that cavities open to the outside through pores or slots are created. These essentially closed channels are in particular created by bending or tilting the fin (U.S. Pat. Nos. 3,696,861, 5,054,548), by splitting and flattening the fin (DE 27 58 526, U.S. Pat. No. 4,577,381), and by grooving and flattening the fin (U.S. Pat. No. 4,660,630, EP 0 713 072, U.S. Pat. No. 4,216,826).

The mentioned improvements in performance on the outside of the tube have the result that the main share of the entire heat-transfer resistance is shifted to the inside of the tube. This effect occurs in particular during small flow velocities on the inside of the tube; thus, for example, during a partial-load operation. In order to significantly reduce the entire heat-transfer resistance, it is thus necessary to further increase the heat-transfer coefficient on the inside of the tube. This would principally be possible through an increase of the height of the inner fins which, however, is technically difficult to do because of the increasing, strong deformation of the material, and furthermore results in a heavy weight of the structured tube. A heavy weight is, however, undesired for cost reasons.

SUMMARY OF THE INVENTION

The purpose of the invention is to provide a heat exchanger tube and a method of manufacture of heat-exchanger tubes having a performance-increasing inner structure, which heat exchanger tubes are structured on both sides, whereby the share of weight of the inner structure as part of the total weight of the tube may not be higher than in common, helical inner fins with a constant cross-section. The dimensions of the inner and the outer structures of the finned tube must be able to be adjusted independently from one another.

The purpose is inventively attained in a heat exchanger tube of the mentioned type, in which respectively adjacent inner fins are separated by a primary groove extending parallel to the inner fins, in such a manner:

- that the inner fins are intersected by secondary grooves extending at a helix angle $\beta$ measured against the tube axis;
- that the secondary grooves extend at an angle of intersection $\gamma$ of at least 10° with respect to the inner fins, and that the depth T of the secondary grooves is at least 20% of the fin height H of the inner fins.

By creating the secondary grooves, the inner fins now have no longer a constant cross-section. When one follows the course of the inner fins, one sees the change in the cross-sectional form of the inner fins at the areas of the secondary grooves. Additional turbulences are created in the tube-side flowing medium in the area near the wall caused by the secondary grooves which increases the heat-transfer coefficient. It is understood that by adding secondary grooves the share of the weight of the inner structure as part of the total weight of the tube is not increased.

The depth of the secondary grooves is measured from the tip of the inner fin in radial direction. The depth of the secondary grooves is at least 20% of the height of the inner fins. When the depth of the secondary grooves equals the height of the inner fins, then spaced-apart structural elements, which are similar to frustums, are created on the inside of the tube.

According to the invention, in order to produce a heat-exchanger tube structured on both sides with the suggested secondary grooves in the inner structure, the tool for forming the outer fins is built with at least two spaced-apart groups of rolling-disks. The inner structure is formed by two differently profiled mandrels. The first mandrel supports the tube in the first forming area under the first group of rolling-disks and forms first of all helically extending or axially parallel inner fins, whereby these inner fins have first of all a constant cross-section. The second mandrel supports the tube in the second forming area under the second group of rolling-disks with a larger diameter, and forms the inventive secondary grooves into the earlier formed helically extending or axially parallel fins. The depth of the secondary grooves is essentially determined by the selection of the diameters of the two mandrels.

BRIEF DESCRIPTION OF THE DRAWINGS

The invention will be discussed in greater detail in connection with the following exemplary embodiments.

In the drawings.

DETAILED DESCRIPTION

Figure 1:
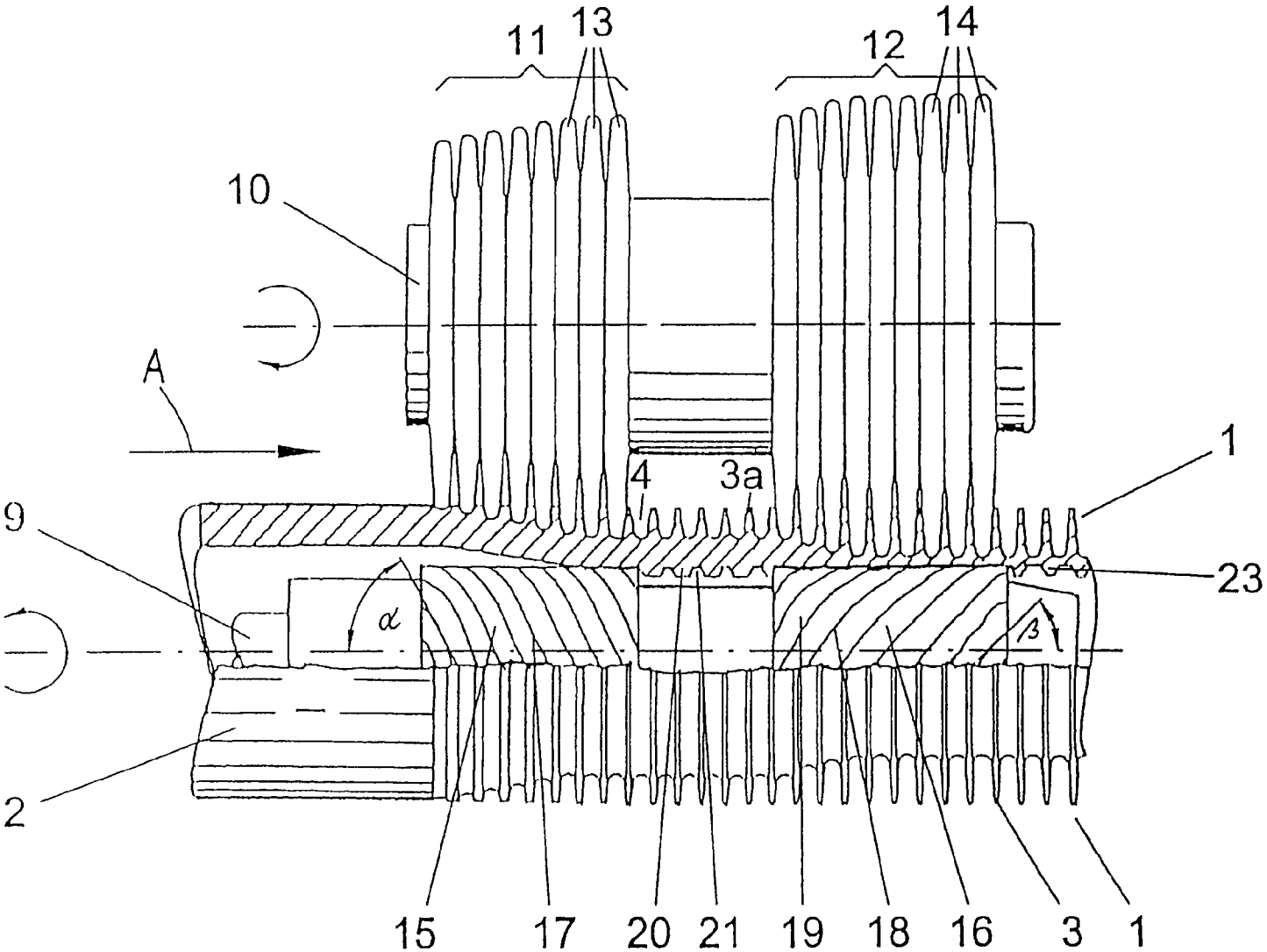
FIG. 1 illustrates schematically the manufacture of an inventive heat-exchanger tube by means of two mandrels with varying orientation of the helix angles.
Figure 2:
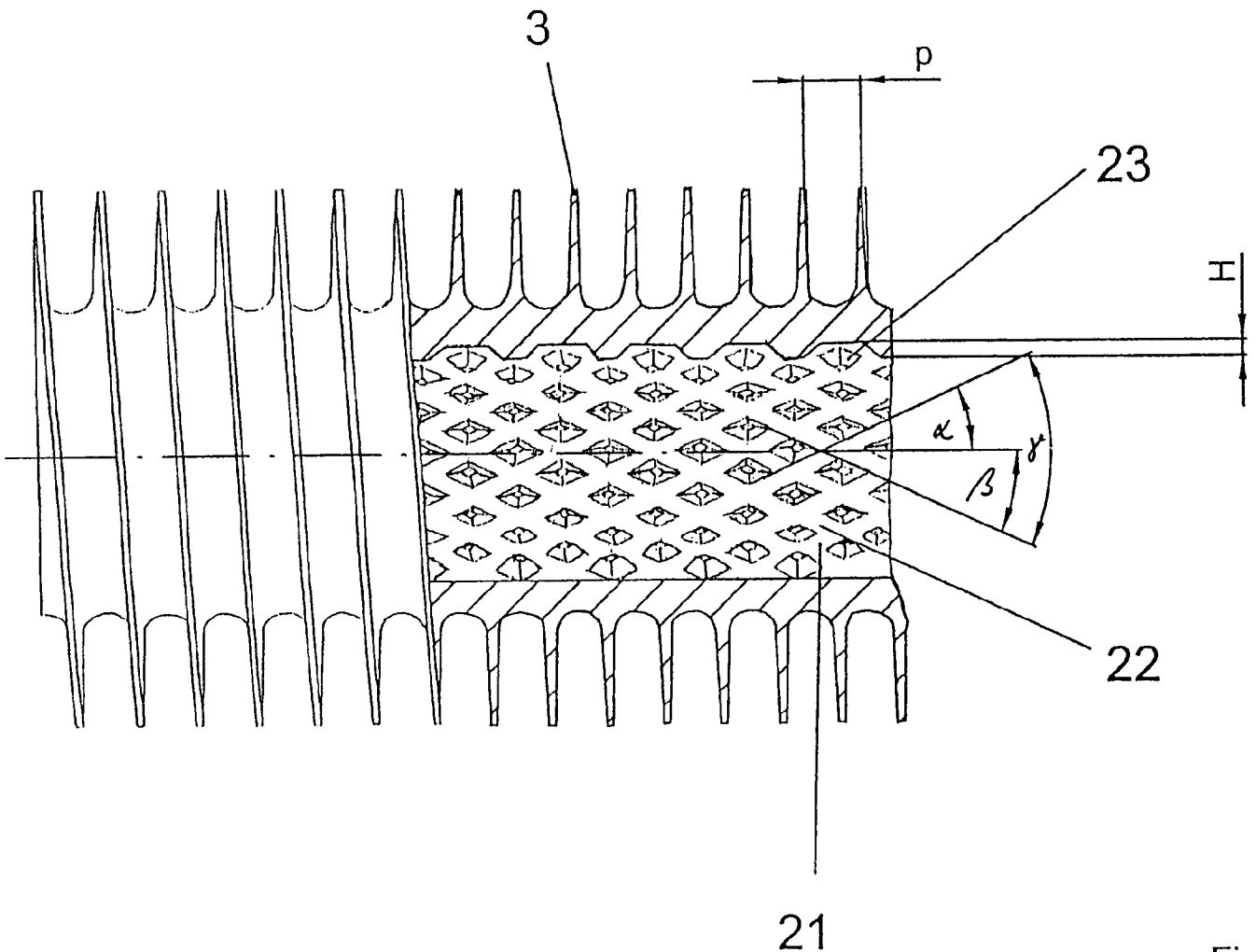
FIG. 2 is a partial view of an inventive heat-exchanger tube in which the secondary grooves expand over the entire height of the inner fin so that frustum-like elements are produced as inner structure. The view is partially a cross-sectional view.

The integrally finned tube 1 according to FIGS. 1 and 2 has fins 3 helically extending over the outside of the tube. The inventive finned tube is manufactured by a finning process (compare U.S. Pat. Nos. 1,865,575 and 3,327,512; and DE 23 03 172) and by means of a device illustrated in FIG. 1.

A device is used which consists of n=3 or 4 arbors 10, onto each of which are integrated at least two rolling tools 11 and 12 which are spaced from one another. (FIG. 1 shows only one arbor for reasons of clarity.) The axis of the arbor 10 is at the same time the axis of the two associated rolling tools 11 and 12, and it extends skewed with respect to the tube axis. The arbors 10 are arranged each offset at 360°/n on the periphery of the finned tube. The arbors 10 can be fed radially. They are in turn arranged in a stationary (not illustrated) milling head. The milling head is fixed in the basic frame of the milling device. The rolling tools 11 and 12 each consist of several side-by-side arranged rolling disks 13 or 14, the diameter of which increases in the direction of the arrow A. The rolling disks 14 of the second rolling tool 12 thus have a larger diameter than the rolling disks 13 of the first rolling tool 11.

The device also includes two profiled mandrels 15 and 16, with the help of which the inner structure of the tube is created. The mandrels 15 and 16 are mounted on the free end of a rod 9 and are rotatably supported relative to one another. The rod 9 is fastened at its other end to the basic frame of the milling device. The mandrels 15 and 16 are to be positioned in the operating range of the rolling tools 11 and 12. The rod 9 must be at least as long as the finned tube 1 to be manufactured. The plain tube 2 is prior to the machining task with the rolling tools 11 and 12 not being engaged, moved almost completely over the mandrels 15 and 16 onto the rod 9. Only the part of the plain tube 2 which, when the finned tube 1 is finished, is the first plain end, is not moved over the mandrels 15 and 16.

The rotatingly driven rolling tools 11 and 12 which are arranged on the periphery of the tube for the purpose of machining the tube, fed radially onto the plain tube 2 and engaged the plain tube 2. The plain tube 2 is rotated in this manner. Since the axis of the rolling tools 11 and 12 is skewed with respect to the tube axis, the rolling tools 11 and 12 form helically extending fins 3 out of the tube wall of the plain tube 2, and at the same time advance the finned tube 1, which is being created, corresponding with the pitch of the helically extending fins 3 in the direction of the arrow A. The fins 3 extend preferably like a multiple thread. The spacing between the centers of two adjacent fins, which spacing is measured lengthwise with respect to the tube axis, is identified as fin pitch p. The spacing between the two rolling tools 11 and 12 must be adapted so that the rolling disks 14 of the second rolling tool 12 engage the grooves 4 which exist between the fins 3*a* formed by the first rolling tool 11. Ideally, this spacing is an integral multiple of the fin pitch p. The second rolling tool 12 then continues the further forming of the outer fins 3.

The tube wall is supported in the forming zone of the first rolling tool 11 (hereinafter referred to as the first forming area) by a first profiled mandrel 15, and the tube wall is supported in the forming zone of the second rolling tool 12 (hereinafter referred to as the second forming area) by a second profile mandrel 16. The axes of the two mandrels 15 and 16 are congruent with the axis of the tube. The mandrels 15 and 16 are profiled differently and the outside diameter of the second mandrel 16 is at most as large as the outside diameter of the first mandrel 15. The outside diameter of the second mandrel 16 is typically up to 0.8 mm smaller than the outside diameter of the first mandrel 15. The profile of the mandrels consists usually of a plurality of grooves which are trapezoidal or almost trapezoidal in cross-section, and which are arranged parallel to one another on the outer surface of the mandrel. The material of the mandrel between two adjacent grooves is identified as a web 19. The webs 19 have an essentially trapezoidal cross-section. The grooves extend usually at a helix angle of 0° to 70° with respect to the axis of the mandrel. The helix angle is in the case of the first mandrel 15 identified with $\alpha$, in the case of the second mandrel 16 with $\beta$. The helix angle of 0° corresponds with the case that the grooves extend parallel to the axis of the mandrel. When the helix angle differs from 0°, the grooves extend helically. Helically extending grooves can be oriented left-handed or right-handed. FIGS. 1 and 2 illustrate the case where the first mandrel 15 has right-handed grooves 17 and the second mandrel 16 has left-handed grooves 18. One speaks in this case of oppositely oriented grooves 17 and 18 or of varying orientation of the two helix angles $\alpha$ and $\beta$. The helix angles $\alpha$ and $\beta$ can in this case have the same amounts. (The same applies for the case where the first mandrel 15 has left-handed grooves 17 and the second mandrel 16 has right-handed grooves 18.) However, it is also possible that both mandrels 15 and 16 have grooves 17 and 18 with an orientation in the same direction. In this case, however, the helix angles $\alpha$ and $\beta$ must differ with respect to their amount. The two mandrels 15 and 16 must be rotatably supported with respect to one another.

The radial forces of the first rolling tool 11 press the material of the tube wall into the grooves 17 of the first mandrel 15. This forms helically extending inner fins 20 on the inner surface of the finned tube 1. Primary grooves 21 extend between two adjacent inner fins 20. Corresponding with the form of the grooves 17 of the first mandrel 15, these inner fins 20 have an essentially trapezoidal cross-section, which remains constant first of all along the inner fin. The inner fins 20 are inclined with respect to the tube axis at the same angle α (helix angle) as the grooves 17 with respect to the axis of the first mandrel 15. Thus the helix angle of the inner fins 20 is the same as the helix angle α of the first mandrel 15. The height of the inner fins 20 is identified with the letter H and is usually in the range of 0.15-0.40 mm.

The inner fins 20 are pressed onto the second mandrel 16 by the radial forces of the second rolling tool 12. Since the grooves 18 of the second mandrel 16 extend at a different angle with respect to the mandrel axis and thus at a different angle with respect to the tube axis than the grooves 17 of the first mandrel 15, the inner fins 20 strike by sectors a groove 18 or a web 19 of the second mandrel 16. In the sectors where an inner fin 20 strikes a groove 18, the material of the inner fin 20 is pressed into the groove. In the sectors where an inner fin 20 strikes a web 19, the fin material is deformed and secondary grooves 22, which extend parallel to one another, are impressed. Corresponding with the form of the webs 19 of the second mandrel 16, the secondary grooves 22 have a trapezoidal cross-section. Secondary grooves 22, which are impressed into varying inner fins 20 by the same web 19, are arranged in alignment with one another. The helix angle, which the secondary grooves 22 form with the tube axis, equals the helix angle β, which the grooves 18 of the second mandrel 16 define with the axis of the second mandrel 16. The angle of intersection γ, which the secondary grooves 22 define with the inner fins 20 results, in the case of mandrels 15 and 16 where the grooves 17 and 18 are oriented in the same direction, from the difference of the helix angles α and β, in the case of mandrels 15 and 16 where the grooves 17 and 18 are oriented in opposite directions, from the sum of the helix angles α and β. The angle γ is at least 10°, typically it lies in the range between 30° and 100°, preferably between 60° and 85°. Angles γ less than 90° can be easier controlled with respect to manufacturing than angles γ larger than 90° and cause usually a smaller pressure drop than angles γ larger than 90°.

The depth T of the secondary grooves 22 is measured from the top of the inner fin 20 in radial direction. By suitably selecting the outside diameters of the two mandrels 15 and 16, and by suitably selecting the outside diameters of the respectively largest rolling disks of the two rolling tools 11 and 12, the depth T of the secondary grooves 22 can be varied. The smaller the difference in the outside diameter between the first mandrel 15 and the second mandrel 16, the larger is the depth T of the secondary grooves 22. However, a change of the outside diameter of one of the two mandrels 15 and 16 does not only result in a change of the depth T of the secondary grooves 22, but causes usually also a change of the height of the outer fins 3. However, this effect can be balanced by modifying the design of the rolling tools 11 and 12. In particular, the largest rolling disks 13 of the first rolling tool 11 can for this purpose be used as the smallest rolling disks 14 of the second rolling tool 12 or the smallest rolling disks 14 of the second rolling tool 12 as the largest rolling disks 13 of the first rolling tool 11.

Figure 3:
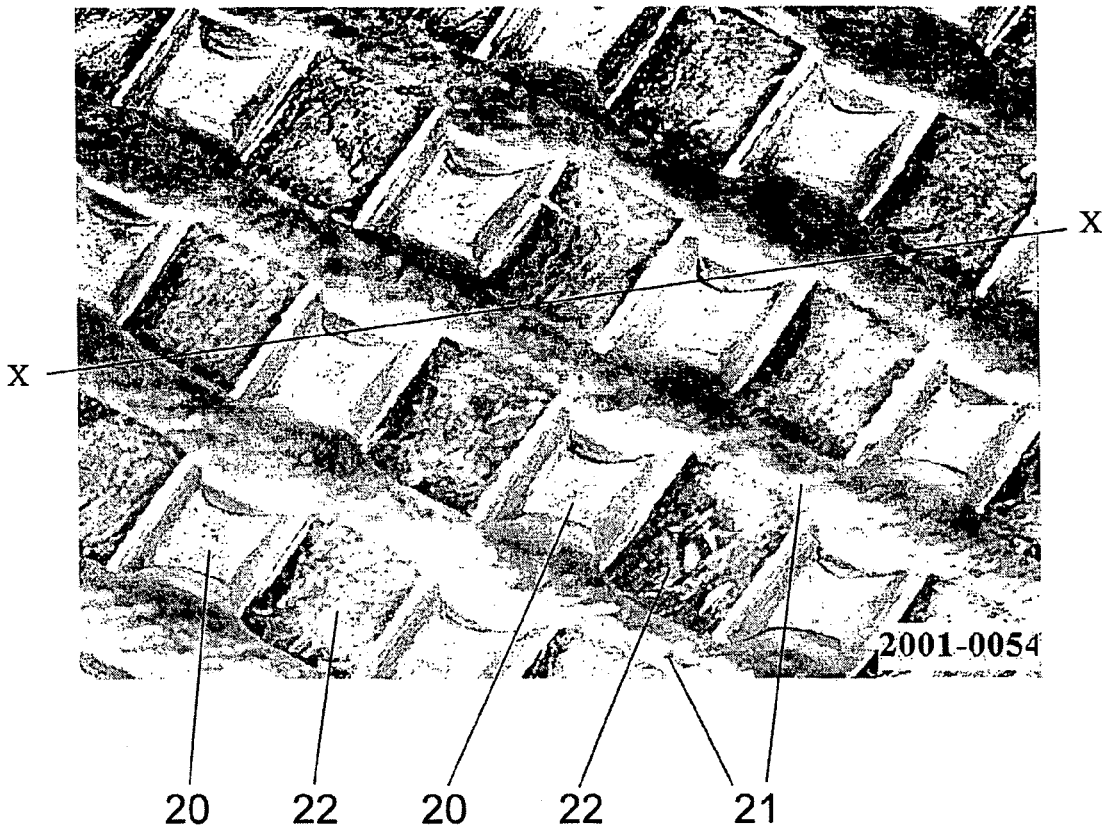
FIG. 3 is a photo of an inner structure in which the secondary grooves extend only over a portion of the height of the inner fin.

In order to clearly influence the flow of liquid flowing in the tube, the depth T of the secondary grooves 22 should amount to at least 20% of the height H of the inner fins 20. The dimension T amounts preferably to at least 40% of the height H of the inner fins 20. When the depth T of the secondary grooves 22 is less than the height H of the inner fins 20, then the finish-form of the finned tube 1 still shows the course of the inner fins 20. This is illustrated in FIG. 3. Along the course of the inner fins 20, however, changes now the cross-sectional form of the inner fins 20. The height of the inner fins 20 is reduced at the areas of the secondary grooves 22 by their depth T. The primary grooves 21 extend without interruption between the inner fins 20. Aligned secondary grooves 22 are spaced apart by the primary grooves 21.

Figure 4:
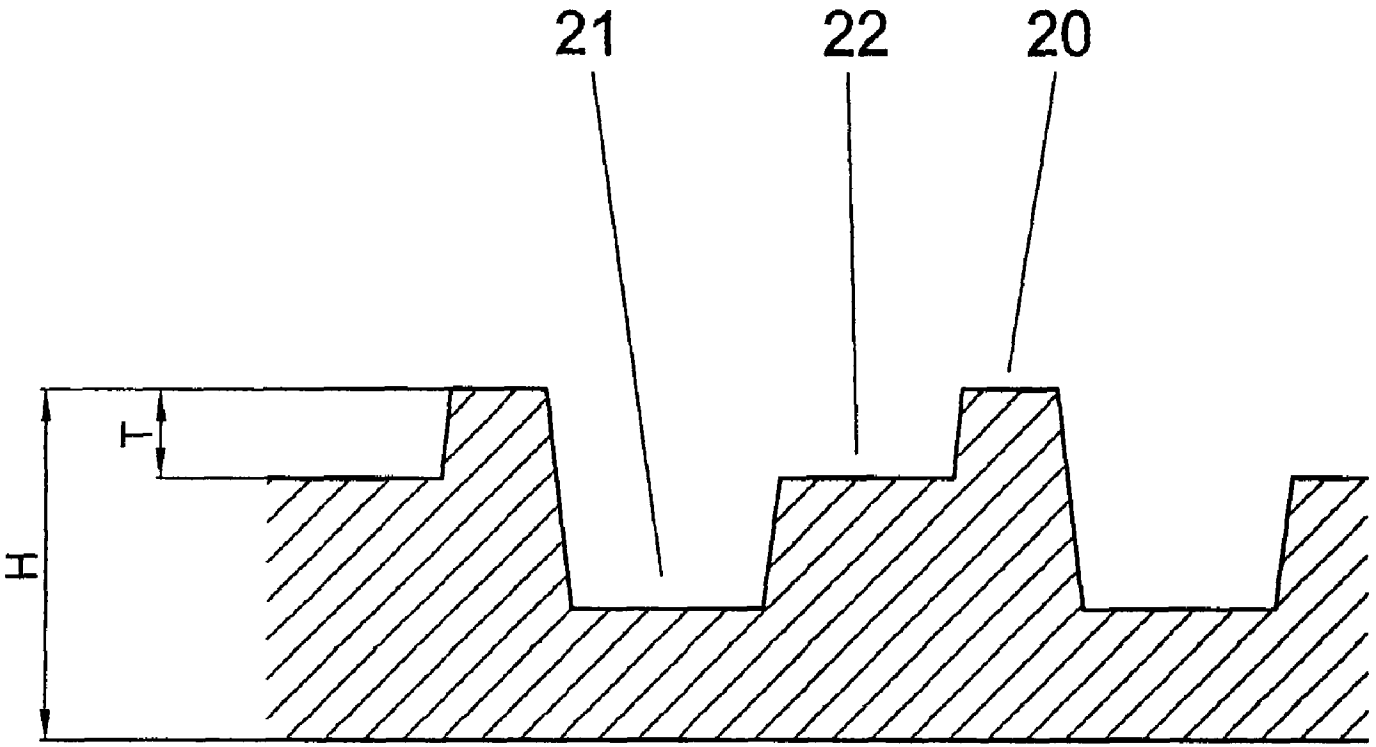
FIG. 4 is a schematic cross-sectional view of the inner structure of FIG. 3 taken along the line X-X of FIG. 3.

FIG. 4 schematically illustrates a cross-section of the inner structure of FIG. 3 taken along the line X-X of FIG. 3. The height relationships between inner fins 20, primary grooves 21 and secondary grooves 22 can here be clearly recognized.

When the depth T of the secondary grooves 22 equals the height H of the inner fins 20, then the course of the inner fins 20 can no longer be recognized on the finish form of the finned tube 1. The inner fins 21 are in this case divided by secondary grooves 22 into individual, spaced-apart elements 23. This is illustrated in FIG. 2. Due to the trapezoidal cross-section of the first of all formed inner fins 20 and the secondary grooves 22, the spaced-apart elements 23 have the form of frustums.

The density of the intersecting points of inner fins 20 and secondary grooves 22 is determined by the profiling on the two mandrels 15 and 16. The density of the intersecting points lies preferably between 90 and 250 intersecting points per $cm^2$. The inner tube surface serves hereby as reference surface, which results when one would completely remove the inner structure from the tube.

The inner structure of the finned tube 1 is provided with additional edges by the secondary grooves 22. When liquid flows on the inside of the tube, then additional turbulences in the liquid are created at these edges, which turbulences improve the heat transfer to the tube wall. The pressure drop of the liquid flowing in the tube usually increases to the same degree as the heat-transfer coefficient. By suitably selecting the dimensions of the inner structure, in particular of the angle of intersection γ and the depth T of the secondary grooves 22, this increase of the pressure drop can, however, be favorably influenced.

The description of the inventive manufacturing method shows that through a plurality of the tool parameters, which can be selected with this method, the dimensions of the outer and inner structure can be adjusted independently from one another in wide ranges. For instance, by dividing the rolling tool into two spaced-apart rolling tools 11 and 12, it is possible to vary the depth T of the secondary grooves 22 without simultaneously changing the height of the outer fins 3.

Finned tubes for air conditioning and refrigeration engineering, which finned tubes are structured on both sides, are often manufactured out of copper or copper alloys. Since with these metals the pure material price carries a not insignificant portion of the entire costs of the finned tube, competition demands that at a specified tube diameter the weight of the tube is as low as possible. The share of the weight of the inner structure as part of the entire weight is 10% to 20% for today's commercially available finned tubes depending on the height of the inner structure and thus depending on performance. The performance of such tubes can be significantly increased with the inventive secondary grooves 22 in the inner fins 20 of finned tubes, which are structured on both sides, without that the share of the weight of the inner structure is increased. In the case of finned tubes, which consist of materials with a density of 7.5 to 9.5 $g/cm^3$ (thus, for example, copper, copper alloys or steel), the share of the weight of such an inner structure, which share refers to the outer envelope surface of the finned tube, lies usually between 500 $g/m^2$ and 1000 $g/m^2$, preferably between 600 $g/m^2$ and 900 $g/m^2$. In the case of finned tubes, which consist of materials with a density of 2.5 to 3.0 $g/cm^3$ (thus, for example, aluminum), the share of the weight of such an inner structure, which share refers to the outer envelope surface, lies usually between 150 $g/m^2$ and 300 g $m^2$, preferably between 180 g/$m^2$ and 270 g/$m^2$. When one selects the width of the primary grooves 21 and of the secondary grooves 22 to be large, then a low weight of the inner structure can be realized.

Figure 5:
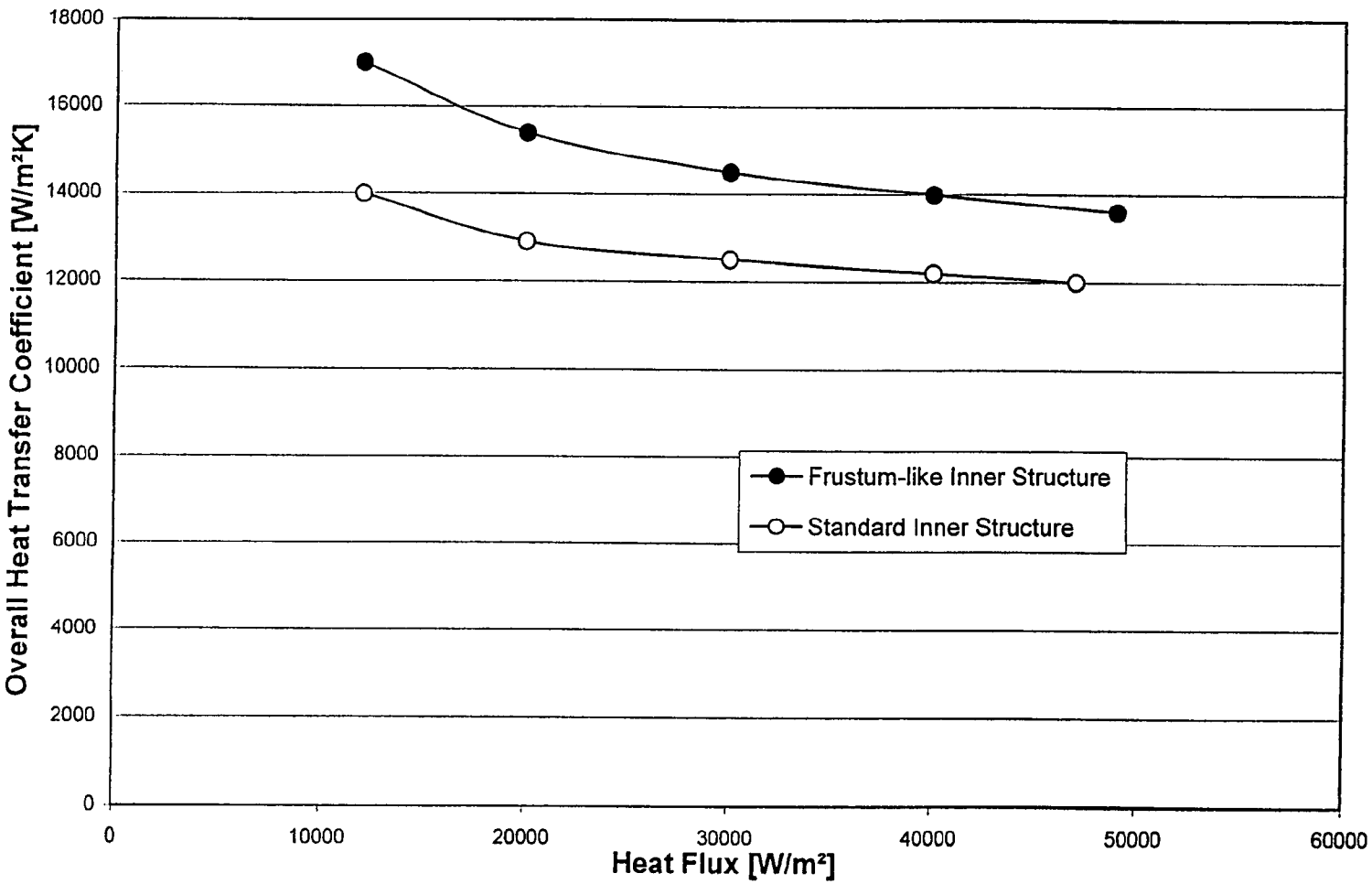
FIG. 5 shows a diagram which documents the performance advantage of the secondary grooves of the inner structure.

FIG. 5 shows a diagram which documents the performance advantage of the inventive inner structure. Illustrated is the overall heat-transfer coefficient versus the heat-flux during condensation of refrigerant R-134*a* on the outside of the tube and cooling-water flow on the inside of the tube. The condensation temperature is 36.7° C., the water velocity 2.4 m/s. The two compared finned tubes have the same structure on their outside, however, they differ in the inner structure, as is identified in the diagram. The state of the art is hereby represented by the tube which has a standard inner structure with a height of 0.35 mm. In the case of the inventive finned tube with inner frustum-like structure similar to FIG. 2, the height of the frustums is approximately 0.30 mm, the density of the intersecting points of inner fins 20 and secondary grooves 22 is 143 per $cm^2$, and the angle $\gamma$ is 96°. The finned tube with inner frustum-like structure has an advantage in the overall heat-transfer coefficient of 13% to 22%. This advantage is caused solely by the inner structure since the shell side heat-transfer coefficient is the same in both tubes.

The use of inner fins with secondary grooves to improve the heat transfer on the inside of heat-exchanger tubes is known in tubes which have merely an inner structure and a plain outside. In the case of seamless tubes, such inner structures are created by means of two differently profiled mandrels (for example, JP OS 1-317637). This technique has been utilized up to now only in tubes which are plain on the outside of the tube. The transfer of this technique onto integrally rolled finned tubes, which are structured on both sides is, however, not obvious due to the clearly different manufacturing methods. In the case of tubes which are plain on the outside, the radial force needed to produce the inner structure is applied by relatively wide rollers or balls arranged on the outside of the tube. The advance of the tube in the axial direction of the tube is hereby accomplished by a separate pulling device. In contrast to this, in the case of integrally rolled finned tubes which are structured on both sides, both the radial force for the simultaneous forming of the outer and inner structure and also the axial force for advancing the tube are solely created by the rolling tool which is constructed of relatively thin rolling disks. The most efficient, commercially available finned tubes are manufactured with rolling disks, the thickness of which is between 0.40 mm and 0.65 mm.

What is claimed is:

1. A method for the manufacture of a heat-exchanger tube, comprising integral outer fins and inner fins worked out of a tube wall which extend helically on an outside of the tube and extend axially parallel or helically on an inside of the tube, and the inner fins are intersected by secondary grooves, in which the following method steps are carried out:

helically extending outer fins are formed by a first rotatingly driven rolling tool, which is mounted on an arbor, in a first forming area on the outside of a plain tube by fin material obtained by displacing material from the tube wall by means of a first finning step, and the finned tube which is being created is rotated by radial forces and moved axially corresponding with the helical fins which are being created, since the axis of the rolling tool is skewed with respect to the tube axis, whereby the outer fins are formed out of the otherwise nonformed plain tube;

the tube wall is supported in a first forming area by a first profiled mandrel lying in the tube, which mandrel is rotatable and profiled, whereby the radial forces of the first rolling tool presses the material of the tube wall into grooves of the first profiled mandrel to form helically or axially parallel extending inner fins on the inner surface of the tube;

the outer fins are further shaped by a second rolling tool during a second finning step in a second forming area which is spaced from the first forming area, wherein the second rolling tool is mounted on the same arbor as the first rolling tool and hence is rotatingly driven in the same direction as the first rolling tool, and the inner fins are provided with secondary grooves; whereby the tube wall is supported in a second forming area by a second mandrel lying in the tube, which second mandrel is also constructed rotatably and profiled, the profiling of which, however, differs from the profiling of the first mandrel with respect to the amount or the orientation of the helix angle.

2. The method according to claim 1, wherein the spacing between the forming areas is essentially an integral multiple of the fin pitch p.

3. The method according to claim 1, wherein the outside diameter of the second mandrel is smaller than the outside diameter of the first mandrel.

4. The method according to claim 1 for the manufacture of a heat-exchanger tube with oppositely oriented inner fins and secondary grooves, the angle of intersection $\gamma$ resulting from the sum of the helix angles $\alpha$ and $\beta$ ($\gamma=\alpha+\beta$), wherein the first and second mandrels have oppositely oriented grooves.

5. The method according to claim 1 for the manufacture of a heat-exchanger tube with inner fins and secondary grooves which extend in the same direction, the angle of intersection $\gamma$ resulting from the difference of the helix angles $\alpha$ and $\beta$ ($\gamma=\alpha-\beta$), wherein the first and second mandrels have grooves oriented in the same direction.

6. The method according to claim 1, wherein depth T of the secondary grooves is adjusted by selecting the diameters of the first and second mandrels and by selecting the diameters of the respectively largest rolling disks of the first and second rolling tools.

7. A method for the manufacture of a heat-exchanger tube having outer fins that extend helically about an outer surface of the tube and inner fins that extend axially or helically on an inner surface of the tube, the inner fins being intersected by secondary grooves, the method comprising the steps of:

providing a mandrel rod having an axis;

providing a first rotatable mandrel with a first profile on the outer surface thereof secured to the mandrel rod;

providing a second rotatable mandrel with a second profile on the outer surface thereof secured to the mandrel rod and axially spaced from the first mandrel;

placing about the mandrel rod a plain tube having a tube wall with an inner surface and an outer surface to be worked, the plain tube having a tube axis;

providing at least one arbor spaced from the mandrel rod;

providing a first rolling tool mounted to the arbor, an axis of the first rolling tool being skewed with respect to the tube axis, and wherein the first rolling tool is positioned radially outwardly from the first mandrel to provide a gap for receiving a tube therebetween;

providing a second rolling tool mounted to the arbor and axially spaced from the first rolling tool, wherein the second rolling tool is positioned radially outwardly from the second mandrel to provide a gap for receiving the tube therebetween;

rotatably driving the first rolling tool to apply inward forces on the outer surface of the tube to form helically extending outer fins and move the tube axially, while the inward forces of the first rolling tool simultaneously press material of the tube wall into grooves of the first profiled mandrel to form helically or axially parallel extending inner fins on the inner surface of the tube; and after axial movement of the tube advances the tube into the gap between the second rolling tool and the second profiled mandrel, driving the second rolling tool to apply inward forces to the outer surface of the tube to provide a second finning of the outer fins, while the inward forces simultaneously press material of the tube wall into grooves of the second profiled mandrel to form helical secondary grooves on the inner surface of the tube that differ from the profile of the first mandrel with respect to orientation of a helix angle, whereby a heat-exchanger tube is manufactured.

8. The method of claim 7, wherein the first rolling tool has a plurality of rolling disks and the second rolling tool has a plurality of rolling disks defining respective forming areas, and wherein the axial spacing between the forming areas is essentially an integral multiple of a fin pitch p of the outer fins of the tube as formed by the rolling disks.

9. The method of claim 8, wherein depth T of the secondary grooves is adjusted by selecting diameters of the first and second mandrels and by selecting diameters of the largest rolling disks of the first and second rolling tools.

10. The method of claim 7, wherein the first and second rolling tools are driven simultaneously in the same direction.

11. The method of claim 7, including a plurality of arbors spaced about the mandrel rod and having a plurality of rolling tools mounted thereon.

12. The method of claim 7, wherein an outside diameter of the second mandrel is less than the outside diameter of the first mandrel.

13. The method of claim 7, wherein the first and second mandrels have helical grooves oriented in the same direction.

14. The method of claim 7, wherein the first and second mandrels have helical grooves oriented in opposite directions.

15. The method of claim 7, wherein the method is free from additional steps that work the heat-exchanger tube.

16. The method of claim 7, wherein the outside diameter of the first mandrel is not more than 0.8 mm greater than the outside diameter of the second mandrel.

* * * * *